US012161943B2

(12) United States Patent
Garofalo

(10) Patent No.: US 12,161,943 B2
(45) Date of Patent: Dec. 10, 2024

(54) SYSTEM FOR REDUCING THE CONSUMPTION OF AN ELECTRONIC DIE

(71) Applicant: XPLORED S.R.L., Genoa (IT)

(72) Inventor: Enrico Garofalo, Chiavari (IT)

(73) Assignee: XPLORED S.R.L., Rapallo (IT)

( * ) Notice: Subject to any disclaimer, the term of this patent is extended or adjusted under 35 U.S.C. 154(b) by 388 days.

(21) Appl. No.: 17/628,762

(22) PCT Filed: Nov. 12, 2020

(86) PCT No.: PCT/IT2020/050281
§ 371 (c)(1),
(2) Date: Jan. 20, 2022

(87) PCT Pub. No.: WO2021/095079
PCT Pub. Date: May 20, 2021

(65) Prior Publication Data

US 2022/0379194 A1 Dec. 1, 2022

(30) Foreign Application Priority Data

Nov. 14, 2019 (IT) ..... 102019000015938

(51) Int. Cl.
*A63F 9/04* (2006.01)
*A63F 9/24* (2006.01)

(52) U.S. Cl.
CPC ..... *A63F 9/0468* (2013.01); *A63F 9/24* (2013.01); *A63F 2009/2494* (2013.01)

(58) Field of Classification Search
CPC ..... A63F 9/0468; A63F 9/24
See application file for complete search history.

(56) References Cited

U.S. PATENT DOCUMENTS 4,034,988 A * 7/1977 Goldner ..... G07C 15/006 463/22
7,017,905 B2 * 3/2006 Lindsey ..... A63F 9/0468 273/138.2

(Continued)

FOREIGN PATENT DOCUMENTS

DE 102013106005 A1 12/2013
DE 102013216784 A1 2/2015

(Continued)

OTHER PUBLICATIONS

International Search Report for International Application No. PCT/IT2020/050187 mailed May 20, 2021.

(Continued)

*Primary Examiner* — Chase E Leichliter
(74) *Attorney, Agent, or Firm* — PERKINS COIE LLP; Colin Fowler; Willa Wu

(57) ABSTRACT

The object of the present invention relates to an energy management system of hardware of an electronic RF die for the coordination of the electronic RF die with remote terminals (e.g., PC, tablet, smartphone, gaming console). The system for reducing the consumption of an electronic game die includes four different activation levels of the hardware components, such as the microcontroller and accelerometer. The system includes two different activation thresholds, which can be set and updated dynamically, and are detected by the accelerometer to activate the different hardware components and adjust the transition between operating modes. The system detects the active presence of remote terminals and, particularly, whether or not the data sent has been received. Further, the system dynamically adapts the parameters of the four operating modes and the two activation thresholds to the different use situations of the die, i.e., to different environmental and game conditions.

13 Claims, 7 Drawing Sheets

(56) References Cited

U.S. PATENT DOCUMENTS

| | | | | |
|---|---|---|---|---|
| 7,334,791 | B2 * | 2/2008 | Lindsey | A63F 9/0468 273/146 |
| 10,463,952 | B2 * | 11/2019 | Read | A63F 9/0468 |
| 10,527,685 | B2 | 1/2020 | Garofalo | |
| 11,123,632 | B2 | 9/2021 | Garofalo | |
| 2004/0036213 | A1 * | 2/2004 | Lindsey | A63F 9/0468 273/146 |
| 2004/0160000 | A1 * | 8/2004 | Lindsey | A63F 9/0468 273/146 |
| 2009/0210101 | A1 * | 8/2009 | Hawkins | A63F 9/04 700/297 |
| 2012/0223477 | A1 * | 9/2012 | Zylkin | A63F 9/0468 273/146 |
| 2013/0178275 | A1 * | 7/2013 | Hawkins | A63F 9/04 463/22 |
| 2014/0309016 | A1 * | 10/2014 | Hawkins | A63F 9/04 463/22 |
| 2018/0333638 | A1 * | 11/2018 | Read | A63F 9/0468 |
| 2020/0222793 | A1 | 7/2020 | Garofalo | |
| 2022/0379194 | A1 * | 12/2022 | Garofalo | A63F 9/0468 |

FOREIGN PATENT DOCUMENTS

| | | | |
|---|---|---|---|
| EP | 2522408 | A1 | 11/2012 |
| FR | 2759919 | A1 | 8/1998 |
| WO | 2019035151 | A1 | 2/2019 |

OTHER PUBLICATIONS

Written Opinion for International Application No. PCT/IT2020/050187 mailed May 20, 2021.

* cited by examiner

400

| Mode | Microcontroller (104) | | Accelerometer (103) | | | |
|---|---|---|---|---|---|---|
| | Radio (106) | CPU (105) | Sampling Period (Dt) | Movement Amplitude (Dm) | Movement Duration (Tm) | |
| Low Mode | Off | Off | Dt.L | Dm.L | Tm.L | Ssup |
| Mid Mode | Off | Off | Dt.M | Dm.M | Tm.M | Sinf |
| High Mode | Off | On | Dt.H | - | - | |
| Tx-RX Mode | On | On | Off | Off | Off | |

Dt.L > Dt.M > Dt.H
Dm.L > Dm.M
Tm.L > Tm.M

500

Graph 1 - Standard Bluetooth dice

Graph 2 - From Low to Mid

Graph 3 - From Mid to Mid

Graph 4 - From Mid to Low

Graph 5 - From Mid to Low - Receiver off during wake time

Graph 6 - From Low to Low

Fig.11

| | | Ssup | | | Sinf | | | | |
|---|---|---|---|---|---|---|---|---|---|
| Setting | Sampling Period (Dt.L) | Movement Amplitude (Dm.L) | Movement Duration (Tm.L) | Sampling Period (Dt.M) | Movement Amplitude (Dm.M) | Movement Duration (Tm.M) | Sampling Period (Dt.H) | Face Vg tolerance (dm) | Dice Stability (DV) |
| 1 | Dt.L.1 | Dm.L.1 | Tm.L.1 | Dt.M.1 | Dm.M.1 | Tm.M.1 | Dt.H.1 | dm.1 | DV.1 |
| 2 | Dt.L.2 | Dm.L.2 | Tm.L.2 | Dt.M.2 | Dm.M.2 | Tm.M.2 | Dt.H.2 | dm.2 | DV.2 |
| ... | ... | ... | ... | ... | ... | ... | ... | ... | ... |
| x | Dt.L.x | Dm.L.x | Tm.L.x | Dt.M.x | Dm.M.x | Tm.M.x | Dt.H.x | dm.x | DV.x |
| ... | ... | ... | ... | ... | ... | ... | ... | ... | ... |
| Z | Dt.L.Z | Dm.L.Z | Tm.L.Z | Dt.M.Z | Dm.M.Z | Tm.M.Z | Dt.H.Z | dm.Z | DV.Z |

600

SYSTEM FOR REDUCING THE CONSUMPTION OF AN ELECTRONIC DIE

CROSS-REFERENCE TO RELATED APPLICATIONS

This application is a § 371 national phase application of PCT/IT2020/050281 filed Nov. 12, 2020 entitled "SYSTEM FOR REDUCING THE CONSUMPTION OF AN ELECTRONIC DIE," which claims the benefit of and priority to Italian Patent Application No. 102019000015938 filed Nov. 14, 2019, the contents of which being incorporated by reference in their entireties herein.

TECHNICAL FIELD

The finding and object of the present invention relates to the field of so-called electronic dice, i.e., to those devices which, in practice, are used for board games and parlour games characterized by the support of electronic components. More precisely, the invention relates to an optimized energy management system of the hardware of said devices and for the efficient coordination with remote terminals such as, for example, a PC, a tablet, a smartphone or a gaming console.

The proposed system can conveniently be used to significantly reduce the power consumption of said electronic dice and increase the operating autonomy thereof. In addition, the proposed system can allow, with the same operating duration required, the use of lower-capacity batteries which notoriously lead to smaller dimensions and an effective miniaturization of the devices. Finally, the system obtained allows to reduce the power consumption of various types of dice regardless of the type, shape, results and functions thereof.

BACKGROUND ART

Dice have been used in the world of games since Roman times, but their use has changed over time and today the use of these playful elements is very widespread in applications and games in which an element of chance is to be introduced. Over time, in addition to the traditional cube-shaped dice, dice with different numbers of faces have been created, generally consisting of regular polyhedra or at least isohedra, progressively invented and introduced on the market, particularly but not exclusively, in the context of so-called board games and so-called role games.

In even more recent times, and with the increasing diffusion of electronic devices, some board games and parlour games, which use physical dice for managing probabilities, have begun to accompany new dice in addition to the traditional dice, commercially known as "electronic dice" which, having the feature of a traditional die, further integrate an automatic orientation detection system and a radio communication system suitably powered by internal batteries, which allow to communicate the result of a roll of the dice towards suitably connected electronic devices such as PCs, smartphones, tablets, consoles, etc.

Entering further into the constructive details of the electronic dice available on the market, it is noted that the predominant architecture for this type of device provides for a radio communication system, typically Bluetooth (or equivalent in low frequency), said radio system being combined with a gyroscope and/or an accelerometer to detect the orientation of the die.

Also from a patent perspective, with the advent and rapid diffusion of technologies related to mobile telephony and essentially the use of accelerometers and gyroscopes in mobile phones, solutions based on this type of hardware have been proposed, such as in the patent EP2522408 (Gik Sp. Z o.o. Sp. k). According to said solution, an electronic board is inserted inside a game die, said electronic board provided with at least one accelerometer, preferably with three axes, and a wireless communication module, preferably Bluetooth, and said components allow tracking and transmitting the result of a die with N faces.

The resolution outline employed in this patent, as well as the one currently prevalent in the field of commercial electronic dice, consists in remotely transmitting the vector which identifies the orientation of the gravity acceleration (more simply called "gravity vector") Vg(x,y,z), detected at the end of the roll of the die, when the object has reached a stable position, leaning on one of the faces and, consequently, showing the user a result, on the opposite face. According to said outline, the receiving device interprets the data received from the electronic die, and in particular said gravity vector Vg(x,y,z), verifying the orientation thereof by means of a look-up type table which defines a priori the unique correspondence between the N faces of the die and the gravity vector transmitted, according to the possible result combinations of the roll. Although this resolution outline is reflected in the majority of commercial electronic dice, it still has many open problems and offers ample room for significant improvements, especially in terms of energy. In fact, the system referred to in the aforementioned patent is characterized, like the majority of the electronic dice currently on the market, for remotely transmitting all the data obtained from the inertial platform (accelerometer and/or gyroscope) in a "raw" manner, delegating to the receiving system the interpretation of the same data, which involves a high use of the radio communication protocol, resulting in energy expenditure which, from a constructive point of view, forces the use of batteries of high, oversized dimensions.

In order to at least partially limit the use of said radio communication protocol, patent EP2522408A1 includes three operating modes, namely: an active mode, a transmission mode and a so-called "idle" mode, i.e., energy saving mode, which consists of an automatic shutdown system of the transmission components, after a predefined time from the acquisition and transmission of the roll result. The resumption from said energy-saving mode, i.e., the reactivation of the device, takes place when the only component left active—accelerometer or gyroscope—detects a significant change in movement.

In this regard, it is included that the accelerometer is calibrated so as to activate the data acquisition and transmission chip (Bluetooth chip) upon the detection of a predefined and unique movement threshold (i.e., identical both during the game and during inactive steps, such as resting on a shelf or transport of the object); in order to guarantee a "natural" operation of the die, i.e., which does not force the user to perform specific and unnatural movements, this threshold must necessarily be reduced, i.e., set to detect and consider, for the purpose of activating the energy-consuming components of the die, even very reduced movements and stresses in terms of intensity.

Therefore, this solution is effective in partially limiting energy consumption, since the expenditure is effectively reduced when the die is at rest or unused (on the table or in the box), but the presence of an activation threshold which includes a reduced stress intensity can lead to involuntary and accidental activations, which significantly impact consumption. The system of EP2522408A1 is therefore unable to distinguish between actual game interactions and random stresses, let alone control and consider the presence of receiving devices ready to receive the transmitted data.

Therefore, the transmission mechanism described above can generate a significant unnecessary energy consumption because the die, with each external stress and regardless of the actual use in the game, activates, waits for a stable result and, if this is achieved, transmits it (typically repeating the transmission N times to be sure that the receiving devices correctly acquire the result itself) and then returns to Idle mode.

To further limit energy consumption, patent EP2522408A1 lastly includes a predetermined, fixed time of the active step, i.e., the step of acquiring the result of the die, said step being moderately energetic. At the end of the envisaged time, even if a stable position has not been reached, the electronics still returns to Idle mode.

The aforementioned measures, although aimed at reducing energy consumption, have numerous drawbacks since the logic of suspending the components according to a predetermined timeout and without the possibility of receiving feedback from players or third party devices, necessarily creates difficulties of use, rather than coordination problems with said remote devices.

On the other hand, to circumvent the problem of excessive energy consumption, some solutions have implemented, within the die, rechargeable batteries provided with a charging system (through exposed electrical contacts or through wireless charging systems), but this type of solution entails a significant increase in the production cost and complexity of the object.

Additional solutions are also known which involve the use of communication systems not based on "active" type electronics (BLE chips or the like), but on passive type RFID systems: some include that a different TAG is associated with each face of the die, while other solutions integrate a TAG capable of feeding and reading the data of an accelerometer, and then transmitting them through the same RFID communication protocol. However, these solutions greatly limit the field of use of the devices since in order to function properly, the objects must necessarily be used in a dedicated roll area, covered by the signal of an RFID antenna; moreover the first type of solutions has high levels of inaccuracy deriving from the possibility that more than one TAG is read when the die has reached a stable position, making it difficult to understand the correct result of the roll; on the other hand, the second type of solutions has limits related to the difficulty of operating the system in certain positions and conditions, due to the fact that the RFID antennas are not omnidirectional.

Finally, some electronic dice are known which, to reduce consumption during periods of non-use of the apparatus, integrate a switch to turn the device off and on only if it is used. Regardless of the careful use of this switch (moreover not deterministic since it is left to the user's discretion), the proposed system is not only uncomfortable for the player, but also difficult to modulate and adapt: in fact, dice with different characteristics exist, which vary for the number of faces as well as for the size of the polyhedra used, for which the use of a switch, although theoretically applicable to different geometries, requires expensive calibrations and specific balances for each shape, obliging to create a dedicated electronic board for each type of die.

DISCLOSURE OF THE INVENTION

The proposed invention relates to a system for the energy efficiency of the components installed in electronic radio frequency dice, such as for example the die of the aforementioned EP2522408A1. Said devices typically comprise an accelerometer and a microcontroller including CPU, memory and radio frequency transmitter—said transmitter preferably but not necessarily of the Bluetooth type. This management system, exploiting the aforementioned hardware and coordinating appropriately with connected remote devices, will have to activate the aforementioned components dynamically, depending on the gaming situations and only in the times and in the ways strictly necessary, minimizing the contribution thereof in terms of energy consumption.

The aforementioned objects arise from the experimental observation of the different weight of the hardware components on the overall energy consumption of an electronic die. In particular, it has been observed that for a microcontroller, the order of magnitude of the consumption of the radio systems during transmission operations is about 10 mA, the order of magnitude of only the active CPU is about 1 mA, while the consumption in rest mode is less than 1 μA. It is also known that the energy consumption of an accelerometer varies according to the use thereof and particularly the activation state thereof and also the sampling frequency, i.e., the frequency with which said sensor detects the movement data and calculates the stresses and, consequently, the orientation of the gravity vector. In particular, the consumption of said component can be about 50 μA if the sampling frequency has the order of hundreds of Hz, or about 4 μA at a few tens of Hz, up to about 1 μA at a frequency of a few Hz.

It follows that the overall consumption of the electronic die, depending on the activation of the different constituent components, can vary by some orders of magnitude passing from a minimum threshold of a few μW (if the radio is off, the CPU is at rest and the accelerometer is set at a sampling frequency of a few Hz), up to a maximum value of a few tens of mW (if the radio is transmitting, the CPU is active and the accelerometer works at a high sampling frequency), this obviously passing through intermediate thresholds if a part of these components is not used or is made to work at different frequencies.

Starting from the aforementioned observations, the proposed invention aims to minimize the activation times and steps of the individual energy-consuming hardware components of an ordinary electronic die, in order to reduce the overall energy consumption thereof. In practice, it has in fact been observed that electronic RF dice limit the use of transmission systems for energy purposes through a typically time-out logic for which the device, once the result of a roll is detected, activates the transmission systems for a certain predetermined time (cautiously oversized), during which the data of the inertial platform is transmitted. This transmission is one-sided, i.e., it consists of a number of attempts to broadcast the result of the roll. The number N of attempts (for example 5 or 10, in a time interval of a few seconds, which can vary from apparatus to apparatus) is set according to a conservative logic, to ensure reliability of reception by connected third party devices and at the same time limit excessive consumption of the energy resource. At the end of the last of N attempts, the electronic die deactivates the transmission components in order to save energy.

Furthermore, it should be noted that in the most widespread implementations, the transmission is one-way (broadcast in TX only), this choice also being dictated by energy-saving logic.

However, although apparently focused on saving energy, in reality the aforementioned implementation choices limit the ability to exploit the hardware platform in an energy-efficient manner. In particular, the choice of transmission only mode limits the independence of the die and the possibility of coordinating with third party devices: since there is no feedback on the presence of connected terminals or indications of receipt of the roll result, it is necessary to perform a large number of broadcast transmissions (the N attempts mentioned above), even if the transmission is correct already at the first attempt. It follows that a consumption reduction mechanism such as the use of a single transmission mode results, on the contrary, in a statistically excessive, unjustified and in any case not optimizable use of highly energetic devices and functionalities.

To overcome the aforementioned limits and for obvious reasons of cost, uniformity and convenience of use compared to the commercially known solutions, the proposed solution includes an intelligent and adaptive control of the hardware of an electronic die, and especially of the energy-consuming components, able to significantly reduce consumption in the most varied conditions of use.

This system, combined with a multi-level architecture, allows to remotely provide, with minimum energy expenditure, the result of the roll already calculated and ready, only if necessary and based on the rules and situations of specific use which arise from time to time during the game.

For obvious reasons of uniformity and ductility with respect to the commercial electronic dice, it is also desired that said energy management system be applicable to any hardware platform for the radio frequency tracking and transmission of the result of rolling a die, i.e., which is adaptable and usable for various types of die regardless of the shape, functions and method of use thereof. It is also desired that this structure, contrary to the commercial electronic dice currently available, is not limited to transmitting all the data obtained from the inertial platform (accelerometer, gyroscope, etc.) to the remote system, but is equipped with its own intelligence and operates in a functionally and energetically more efficient manner, directly transmitting the result of the roll, depending on the type of die in which it is housed and on the different results (numbers, symbols, characters, commands, etc.) which said die includes.

In particular, it is desired that said roll tracking apparatus employs transmission systems (RF) and those for determining the result of the roll (microcontroller and accelerometer/gyroscope), which are notoriously responsible for the greater energy expenditure, only in useful cases and only for the time strictly necessary, i.e., only with the actual use of the dice by the player and willingness to receive the result by the connected remote game terminal.

Finally, the use of a switch is to be avoided (whose energy saving performance is not guaranteed because entrusted to prudent and imponderable use by players), replacing said switch with an autonomous and intelligent system which allows the device not only to activate itself following the players interactions, as some dice already do, but in particular, to distinguish and discriminate voluntary interactions for the purpose of the game from trivial unwanted stresses, for example of an environmental or fortuitous nature, which have nothing to do with the conduct of the game; this in order to avoid the expenditure of energy for the detection and transmission of unnecessary data.

The proposed solution exploits the standard hardware implemented on the electronic board of electronic RF die, allowing to significantly improve the energy performance thereof and, consequently, increasing the life of the attached battery, through a management system of the energizing components of said hardware and, in particular, of the microcontroller and accelerometer installed on the board of the electronic die.

Said system for reducing the consumption of an electronic game die is characterized by: Four different operating modes, i.e., four different activation levels of the components, of which two purely operating modes (one first active mode aimed at determining the result of the roll, and a second, also active, transmission mode of the result) and two energy saving modes (minimum consumption in the event of non-use, reduced consumption in the time between two rolls of the die).

Two different activation thresholds, which can be set and updated dynamically, detected by the accelerometer and aimed at activating the different hardware components and adjusting the transition between said operating modes: a first threshold characterized by higher intensity and duration values, useful for detecting high and prolonged movement levels and used to reactivate the die when it is in the minimum consumption mode; a second threshold characterized by lower movement intensity and duration values and used during the game for the transition from the reduced consumption state to the active state, thanks to which it is possible to guarantee the sensitivity necessary to determine the result of a roll during current use.

Means for the bidirectional transmission, by radio, of data to/from remote game devices, able to detect the active presence of said remote terminals and, particularly, whether or not the data sent has been received, thus avoiding redundant or unnecessary transmissions if said remote devices are no longer active.

Means for dynamically adapting the parameters of the four aforementioned operating modes and the two activation thresholds to the different use situations of the die, i.e., to different environmental and game conditions. In fact, these situations can affect the energy performance of the system and in particular, any geometric irregularities of the roll surface can affect the correct detection of the gravity vector (irregular playing plane, non-horizontal surfaces, etc.), while any unwanted environmental stresses (vibrations, jolts, rolling), can affect the correct dynamometric detection of the intensities of the forces perceived by an accelerometer, making it impossible to detect the result or causing unwanted activations of the electronic board.

The system of the invention allows to autonomously and automatically diversify, based on the game and environmental context, the four different operating modes of the die, namely:

Minimum consumption mode (Low Mode): in said mode the microcontroller is switched off (both the RF transmitter and the CPU) and the accelerometer operates with a reduced sampling frequency and with a higher movement threshold for activation (in intensity and duration). The minimum consumption mode is automatically activated if the die, following a transmission attempt, does not receive responses from remote game devices, indicating that no receiving device is available and that, therefore, there is not an active game situation. Furthermore, said mode is exited, switching to the active state, if the aforementioned upper threshold set on the accelerometer is surpassed, i.e., at an intense movement stimulus (in both entity and duration), reasonably attributable to the will of the player to "activate" the die to start a game session. The use of a high activation threshold allows the device to reactivate from the minimum consumption mode only following a voluntary interaction of the player, thus allowing to eliminate or in any case significantly reduce any unwanted activations of the die (for example in the case of environmental vibrations not connected to the game, dice transport steps, slight accidental stresses during temporary storage, etc.). Even in the event of unwanted activation, since receiving systems are not active (no return signal detected), the apparatus will automatically return to minimum consumption mode, reducing waste.

Reduced consumption mode (Mid. Mode): in said mode the microcontroller is switched off (both the RF transmitter and the CPU) and the accelerometer is set with intermediate sampling frequency and lower activation threshold. Said mode is implemented during the game, in the interlocutory steps between the detection of subsequent rolls, when a third device responds to the attempts to transmit the data by the die, confirming the receipt of the data; once the result of a roll has been transmitted and as soon as confirmation from the receiving apparatus is received, the die will return to reduced consumption mode, waiting for a new roll. This reduced consumption mode is exited, and the active mode of detecting the result of the roll is passed to if the aforementioned lower threshold set on the accelerometer is surpassed, i.e., in the presence of a movement stimulus reasonably attributable to the will of the player to perform a roll of the die. Said lower detection threshold allows the device to activate promptly, as soon as the player takes the die from the support surface and prepares to perform a roll, allowing to discriminate the series of subsequent rolls, performed during the active step of the game, reducing consumption between one roll and the next, but without requiring the player to perform special procedures or unnatural gestures for activation (as would be the case with the use of a higher activation threshold or the use of switches or other shutdown devices).

High consumption mode or active state (High Mode): in said mode the microcontroller is partially on (only the CPU, while the radio is off), and the accelerometer is set at a high sampling frequency. This mode is activated automatically if the accelerometer detects a movement of the die attributable to a roll (surpassing the lower or upper threshold, depending on the mode in which the die is found) and after verifying the presence of third party devices connected by sending an activation signal to said third party devices; in case of confirmation of the presence of a receiver (affirmative response via radio), the CPU is activated and the accelerometer is configured so as to be able to carry out a high frequency sampling of the stresses to which the device is subjected, in order to determine the dynamics of the roll of the die as accurately as possible. This mode is exited after verifying the asymptotic stability of the accelerometer gravity vector and the reliability of the result, established on the basis of modifiable parameters which determine different use criteria and different environmental situations, switching to the transmission mode of the result of the detected roll.

A maximum consumption mode (TX-RX Mode): in said mode the microcontroller is fully on (both CPU and radio), while the accelerometer is off; this mode is activated once the die has reached a stable position, based on the aforementioned configuration parameters: the microcontroller correlates the data detected by the inertial platform with the presets contained in the memory thereof and, based on these, understands whether or not the position reached by the die can be considered "stable" (asymptotically stable) and if so, detects the orientation of the device, consequently calculating the result (i.e., the value of the exposed face, in the event of a valid roll with an almost horizontal stable position, or a "zero" result, in the event of reaching a non-horizontal stable position, for example due to the presence of objects on the game board or for other reasons). Once these calculations have been made, the CPU switches on the radio and transmits only the result (i.e., the number/symbol or value associated with the face facing upwards depending on the types of dice or the null result), repeating the transmission for a certain time and for a series of consecutive times; after each transmission, it remains in reception mode for a short period of time and, if in this interval it receives confirmation of receipt of the result by a third party device, the electronics automatically switches to the reduced consumption mode, without continuing to further and unnecessarily transmit the roll result. If, on the other hand, after a certain number of transmission attempts and/or after a certain predetermined time, it does not receive any acknowledgement of receipt, the system deduces that the game is finished (there is no longer a "remote receiving station" active) and puts itself in minimum consumption mode.

It should also be noted that the aforementioned four activation modes and the consumption thereof, and in particular the transitions therebetween, are integrated and completed by an automatic handshake-based method for detecting the presence of any game terminals ready to receive the possible result of a roll; this method consists in sending a "Ready" command with response control by said devices. This check is carried out every time there are preparations to move from a low consumption step to the active step of detecting the roll and subsequently transmitting the result; sending the "Ready" command, performed at the time of activation, allows to check beforehand that a game session is actually underway, i.e., that there are remote terminals listening. If the check has negative results (NULL), i.e., in the absence of confirmation to the transmission of the "Ready" command, the die immediately returns to minimum consumption mode, without waiting for a stable position and, consequently, without proceeding with the transmission of the roll result, with a significant reduction in energy consumption even with the accidental activation of the device, during transport or when it is not used for game purposes.

DETAILED DESCRIPTION OF THE DRAWINGS

Further features and advantages of the proposed technical solution will appear more evident in the following description of a preferred but not exclusive embodiment shown by way of non-limiting example in the accompanying 7 drawings, in which:

FIG. 11 illustrates a possible structure of the table (or look-up table) preloaded on the memory of the microcontroller, including the useful parameters for managing the components of the die, with the varying of the operating areas and different situations of play and use of the electronic RF die.

BEST MODE FOR CARRYING OUT THE INVENTION

Figure 1:
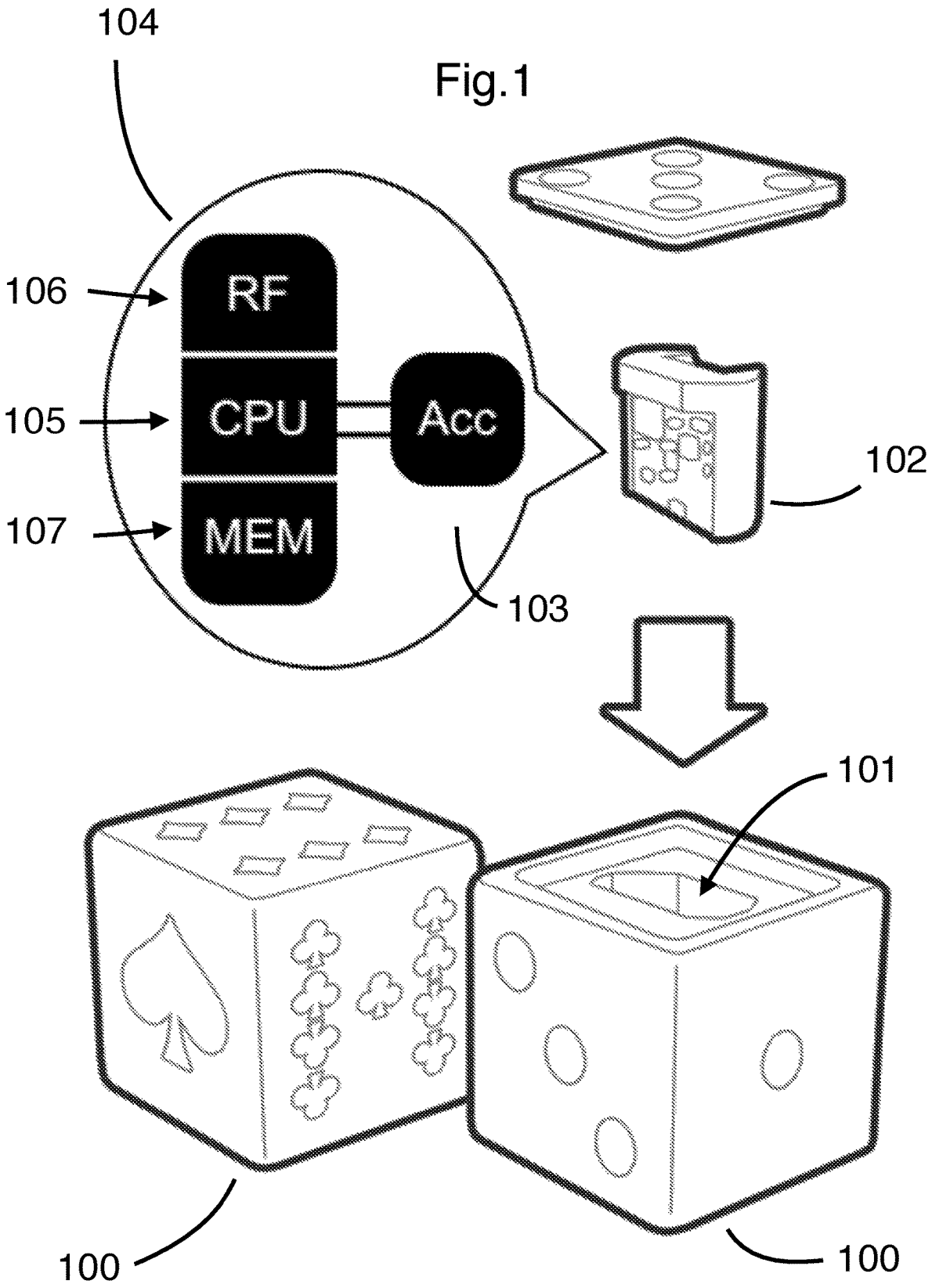
FIG. 1 shows the structure and typical components of an electronic RF die to which the energy saving system object of the invention refers.

With reference to the accompanying drawings, and particularly to FIG. 1 of the same, the typical components of an electronic RF die (100) to which the energy saving system object of the invention refers are shown. Said electronic die (100) typically includes a niche (101) in which an electronic board (102) is housed for determining the roll result and remotely transmitting said result.

To achieve these purposes, the aforementioned board (102) is equipped with an accelerometer (103) and a microcontroller (104). The accelerometer provides the instantaneous value of the amplitude of movement M(t) in real time and processes an instantaneous gravity vector, in the three components thereof [Gx, Gy, Gz]. The microcontroller typically comprises a CPU (105), a memory (107), and an RF radio frequency transmission apparatus (106). Said transmission apparatus will typically be two-way and, by way of example but not limitation, may be of the Bluetooth type, or characterized by other commercial and/or proprietary transmission protocols. The CPU 105 and memory 107 are used to implement:

means for the energy management (activation/deactivation) and the coordination of the various hardware components of the board (102) and in particular to control the microcontroller (104) and the accelerometer (103), according to an outline which includes four operating modes for managing the consumption of the different hardware components and especially the energy-consuming functions (i.e., radio transmission apparatus, CPU and accelerometer) and two activation thresholds, depending on the movement of the die detected by the accelerometer and used for the activation of the hardware components of said board (102) and/or the transition between the aforementioned modes;

means for interpreting the roll result from the data of said accelerometer (103); said interpretation based on a predetermined look-up table loaded into the memory (107), which associates the possible orientation of the asymptotically stable gravity vector Vg(x,y,z) detected by the accelerometer (103) at the end of the roll with the face of the die to which that gravity vector corresponds. This mechanism (further provided with methods of compensation and minimization of acquisition errors related, for example, to environmental interference), allows to determine the result of the roll of the die (100), without having to transmit the entire state of the inertial platform (transmitting only one or two bytes of data, instead of a multiplicity of information related to the value assumed by the acceleration, for each of the at least three axes of the accelerometer).

means for the further optimization of consumption through the management of the RF transmission device (106) and, particularly handshake, to check for the presence of remote game terminals available to receive the roll result, performed in advance, when switching from a low-consumption or reduced-consumption mode to the active mode, i.e., before starting the (highly energy-consuming) procedure for detecting and remotely transmitting the roll result.

Figure 2:
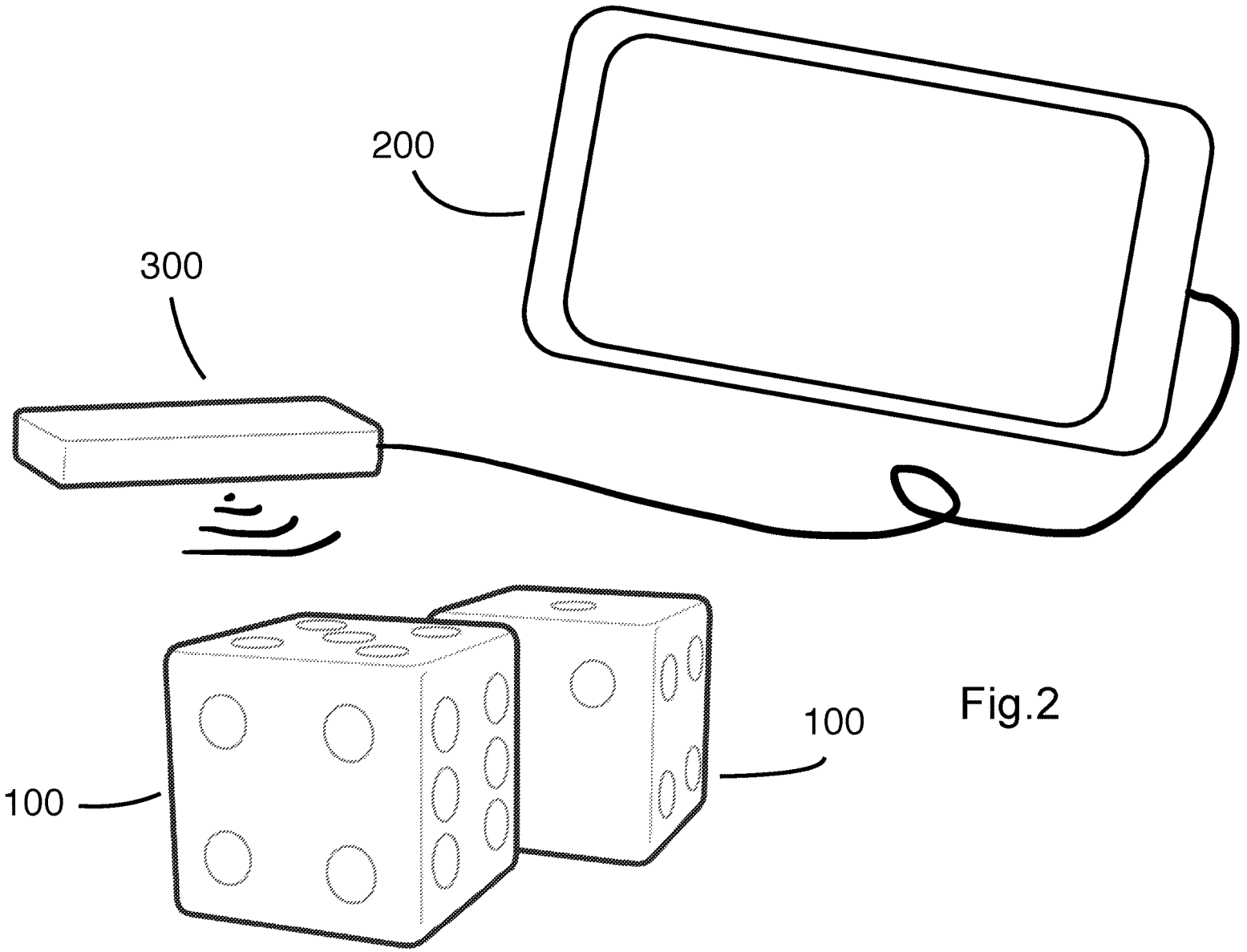
FIG. 2 shows a possible use situation of the die object of the invention.

With reference to the accompanying drawings, and particularly to FIG. 2, a typical situation of use of an electronic RF die (100) of the patent is shown, in which the roll result is transmitted to a remote game terminal (200) such as, for example, a tablet, a PC, a console or a smartphone.

Furthermore, according to this embodiment, there may be a mediator device (300), which acts as a gateway to the connected remote electronic device (200) and is conveniently used to manage and possibly process data relating to rolling one or more dice (100). Said mediator (300) may be necessary, for example, to enable energy management mechanisms to be implemented if game terminals without an RF communication interface compatible with the die's radio systems are used (e.g., with PCs without Bluetooth interface or if using less widespread radio communication technologies and/or protocols, within the die's electronics).

Moreover, thanks to the use of specific communication protocols, the mediator device (300) can allow data to be acquired from a large number of dice (circumventing the limits imposed for example by the Bluetooth protocol) and can be suitably used to perform a preliminary processing of the results of the rolls related to a plurality of dice (100) used, combining them depending on the type of game or application scope in which said dice are used. Moreover, the same mediator device (300) can undertake an analysis of the data transmitted by the dice, regardless of whether the rolls have failed or succeeded, applying analysis algorithms useful to understand if environmental disturbance conditions (e.g., rolling, vibrations, tilt of the game table, etc.) are present and, if they are, communicating to the dice the need to use a different setup for the roll detection parameters and/or for the thresholds for detecting the energy saving modes.

The mediator device (300) involves a communication hardware which uses the same radio protocol as the RF communication device (106) integrated in the control board (102) of the die (100), thus being able to acquire all the results of the different rolls and to retransmit them, individually or in combination with each other, according to the rules of the game and/or the scenario of use, to the remote electronic device. The connection between the mediator device (300) and the remote game terminal (200) may be wired, as shown in FIG. 2, or possibly wireless, using different transmission protocols useful for the purpose. Said mediator device (300) will be provided with an appropriate processing unit, consisting of a memory in which the results of the roll of each of the dice can be stored and a microcontroller capable of combining the different results, according to the different rules and game situations.

Figures 3, 4:
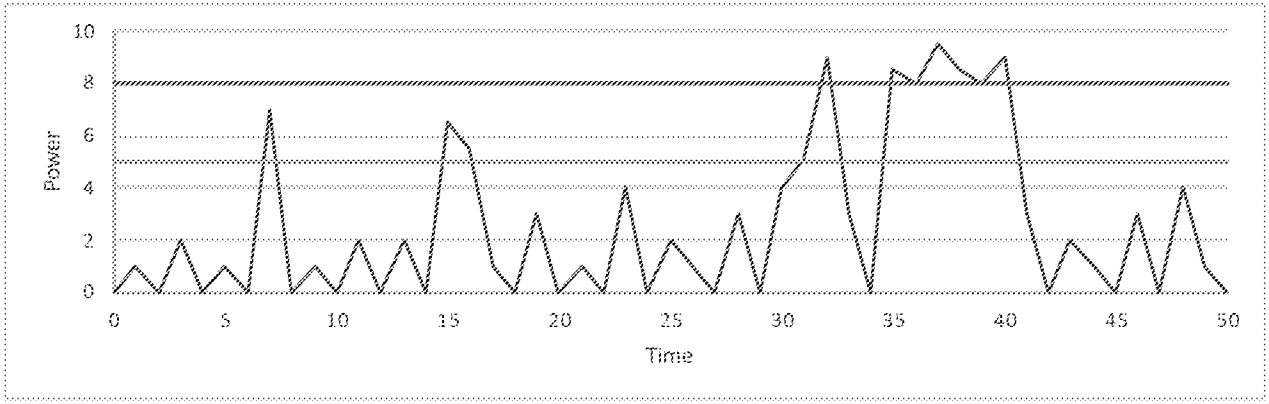
FIG. 3 illustrates a table containing the four different operating modes of energy management/consumption of the die, with the corresponding states of the different energy-consuming components (microcontroller, radio communication apparatus and accelerometer) and the configuration parameters related to the activation thresholds of the accelerometer.
FIG. 4 shows an explanatory graph of the relationship between the stresses (movement intensity and duration) applied to the die and the activation thresholds implemented by the system.

With reference to the accompanying drawings, and particularly to FIG. 3, a table (400) is depicted which outlines the four different operating modes provided by the energy saving system, depending on the conditions of use, detailing the activation states of the main components and the parameters which define the two lower Sinf and upper Ssup activation thresholds of the accelerometer, namely the thresholds through which the accelerometer determines the transition from a resting state, with minimum or reduced consumption, to an active state.

In detail, the four operating modes are as follows:

1. Minimum consumption mode (Low Mode): microcontroller (104) off, both the RF transmitter (106) and the CPU (105), and accelerometer (103) used with reduced sampling frequency (sampling interval—Dt.L—high) and with an upper activation threshold Ssup [intensity Dm.L, duration Tm.L];
2. Reduced consumption mode (Mid. Mode): microcontroller (104) off, both the RF transmitter (106) and the CPU (105), and accelerometer (103) set with intermediate sampling frequency (sampling interval—Dt.M—intermediate) and lower activation threshold Sinf [intensity Dm.M, duration Tm.M];
3. Active state (High Mode): microcontroller (104) partially on (only CPU (105), radio (106) off) and accelerometer (103) set with high sampling frequency (sampling interval—Dt.H—minimum);
4. Transmission state (TX-RX Mode): microcontroller (104) fully on (both CPU and Radio (106)) and accelerometer (103) off.

The sampling intervals Dt.L, Dt.M and Dt.H with which the accelerometer (103) is set in the four aforementioned states are connected by the following inequality:

$$Dt.L > Dt.M > Dt.H$$

The criterion underlying this inequality is to use lower sampling frequencies, that is to say, to reduce the energy consumption of the accelerometer (103), in those situations which do not require accuracy or very short response times. Following this logic, a very low frequency is therefore set at the Low Mode minimum consumption mode, since in this context a minimum accuracy of the device will be sufficient, as long as it is sufficient to detect a first and only stress of significant intensity and duration Ssup, useful to activate the device starting from the state of maximum energy savings and Low Mode minimum consumption. This setting, combined with a high activation threshold in terms of movement intensity Dm.L and duration Tm.L, significantly reduces the involuntary activations of the die (100) connected to random and uncontrolled events, guaranteeing an extremely low consumption for almost all the time between two game sessions.

Similarly, in Mid Mode reduced consumption mode, a reduced frequency, i.e., energy efficient, but of slightly higher intensity, will be applied in order to trace more accurately and, above all, more quickly detect the rolls of the die (100) and, more precisely, the initial step of said rolls. In fact, this mode is activated during the game sessions, between two successive rolls, allowing to significantly reduce consumption in the non-use steps of the device, but guarantees, due to the higher sampling frequency and the lower activation threshold Sinf, for stress intensity and duration, to quickly switch to the active mode as soon as even a reduced stress is detected, corresponding to the picking up of the dice from the game board by the user.

In High Mode active mode, on the other hand, the sampling frequency of the accelerometer (103) must be high, to the detriment of more significant consumption, in order to accurately trace the dynamics of the gravity vector of said accelerometer during the evolutions of the roll of the die (100); this dense sampling will continue until the asymptotic stability of the gravity vector is reached, a situation which indicates that the die has reached a stable position, which will correspond to the correct identification of the result (or a "zero" result, if the assumed stable position is inclined due to the influence of objects present on the playing area or by other disturbance factors).

Finally, during the TX-RX Mode transmission state it is not necessary to track the movement, so the accelerometer is conveniently switched off to avoid unnecessary consumption.

Always referring to the aforementioned FIG. 3 of the attached drawings, it should further be noted that the thresholds Sinf and Ssup, with which the accelerometer (103) is set, are connected by the following inequality, through the following relationships between the components thereof:

$$Dm.L > Dm.M \text{ and } Tm.L > Tm.M$$

The two thresholds Sinf and Ssup are also used for the purpose of optimizing energy consumption and have the dual purpose of voluntarily limiting the sensitivity of the accelerometer in order not to unnecessarily activate the highly energy-consuming components, if the die (100) was subject to stresses not connected to actual use, and at the same time, to ensure the transition between the aforementioned operating and consumption modes if the die (100) is also actually used. Contrary to traditional dice, the presence of a double threshold allows, therefore, to discriminate negligible stresses from those which are significant in the different steps of use.

When the die (100) is in the Low Mode minimum consumption step, typically in cases of non-use, the accelerometer (103) is set with an activation threshold Ssup characterized by high intensity Dm.L and duration Tm.L values and, thanks to this precaution, becomes insensitive to accidental activations which would cause unnecessary consumption. This is the typical case of unwanted stresses (vibrations, accidental collisions, jolts during transport, etc.). In addition to acting as a filter for accidental and unwanted stresses which occur during the Low Mode minimum consumption mode, the upper threshold Ssup of the accelerometer (103) allows to discern voluntary interactions of the player aimed at reactivating the dice (100). In fact, if the player shakes the die (100) with a significant intensity and for a certain period of time, surpassing both parameters of said upper threshold Ssup, the accelerometer would communicate said stimulus to the microcontroller (104), determining the transition to the included subsequent TX-RX Mode or High Mode operating modes.

When the die (100) is in the Mid Mode reduced consumption step, typically in cases of use for multiple and consecutive rolls, the accelerometer (103) is instead conveniently set with an activation threshold Sinf characterized by lower intensity Dm.M and duration Tm.M values and, thanks to this precaution, becomes more sensitive to external stresses and particularly in the order of magnitude of the forces typically impressed by a player when preparing to roll a die (100), thus allowing, therefore, to filter the small accidental stimuli attributable to external causes and not connected to the game dynamics. This is the typical case of unwanted stresses occurring between successive rolls (vibrations, small accidental movements, etc.). In addition to acting as a filter for accidental and unwanted stresses which occur during the Mid Mode reduced consumption mode, the upper threshold Sinf of the accelerometer (103) also allows to discern voluntary interactions of the player during the ordinary game steps. If the player shakes the die (100) with a moderate intensity and for a relatively short time (for example, simply lifting and shaking it briefly in the hand), the accelerometer would instantly communicate this stimulus to the microcontroller (104), determining the transition in the subsequent and included TX-RX Mode, High Mode operating modes.

With reference to the accompanying drawings, and particularly to FIG. 4, the graph (500) is shown which represents, in the time domain, an operating example of the lower Sinf and upper Ssup thresholds with respect to a series of possible stresses/movements detected by the accelerometer (103). In particular, this graph details the intensity components of the two aforementioned thresholds Dm.M and Dm.L and identifies the occasions on which these thresholds are surpassed or not and the time duration of said stimuli, in order to verify whether the time components of said thresholds are also surpassed, i.e., Tm.M and Tm.L.

In particular, it can be seen that, thanks to the threshold Dm.M, when the die is in Mid Mode reduced consumption mode, many lower intensity stresses are filtered, while thanks to the threshold Tm.M, the peak movement corresponding to T1, being very short (T1<Tm.M), is not taken into account, while all subsequent stress peaks (of durations respectively equal to T2, T3 and T4, being longer in duration than Tm.M), are considered by the accelerometer as sufficient to determine the surpassing of Sinf, consequently decreeing the transition to the active mode of the die.

If the die is in the Low Mode minimum consumption mode, in the presence of the same conditions, the threshold Dm.L would allow, already alone, not to consider most of the stresses undergone, but the use of this intensity threshold in combination with the duration threshold Tm.L, also allows to ignore sudden peaks of movement (for example determined by a shock), such as that in T5 (with T5<Tm.L), detecting as valid stimulus for activating the device only that corresponding to a stress of intensity greater than the threshold, prolonged for a high amount of time (T6>Tm.L).

With reference to the accompanying drawings, and in particular to FIG. 5, FIG. 6, FIG. 7, FIG. 8, FIG. 9 and FIG. 10, the consumption diagrams related to different use cases of the die (100) are shown in detail; said diagrams illustrate the energy consumption related to said four different modes and the transitions therebetween, according to different situations of use; said consumption is also compared with the consumption and typical transactions of a traditional electronic die.

Figure 5:
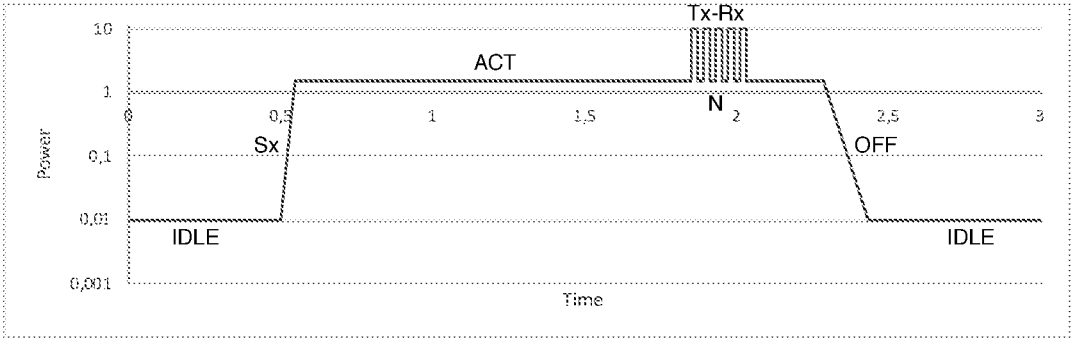
FIGS. 5, 6, 7, 8, 9, 10 show the energy consumption trend in the cases envisaged according to the proposed energy saving system, compared with the consumption of a typical standard electronic die based on RF transmission technologies.

With reference to the accompanying drawings and particularly to FIG. 5, the energy consumption of a typical commercial die in a common operating cycle is shown.

Said graph comprising the steps of:

- initial state in reduced consumption mode (Mid Mode or IDLE);
- transition to the active state (ACT) following an external stress detected by an accelerometer and of an intensity greater than a fixed activation threshold (Sx); said threshold comparable and functionally equivalent to that (Sinf) referred to in the proposed patent;
- acquisition of the stable roll result;
- automatic transition in transmission made (TX);
- broadcasting of the roll result with N transmission attempts during the transmission step (for comparison purposes, it is assumed that 5 data transmission attempts are made);
- switching off the Radio and CPU components (OFF) and transitioning to reduced consumption mode (Mid Mode or IDLE);

It should also be noted that the development and time duration of the steps shown in FIG. 5 is fixed, i.e., it is performed according to predetermined times (x seconds of acquisition of the roll, N attempts to transmit the result, programmed shutdown after x seconds from the transmission). Although cautiously overabundant and overdetermined to ensure the effectiveness of each step, these times cannot be modified depending on the environmental and game situations (for example, reception of the result, actual game in progress, involuntary die rolls, random stresses not connected with the actual game, etc.).

Figure 6:
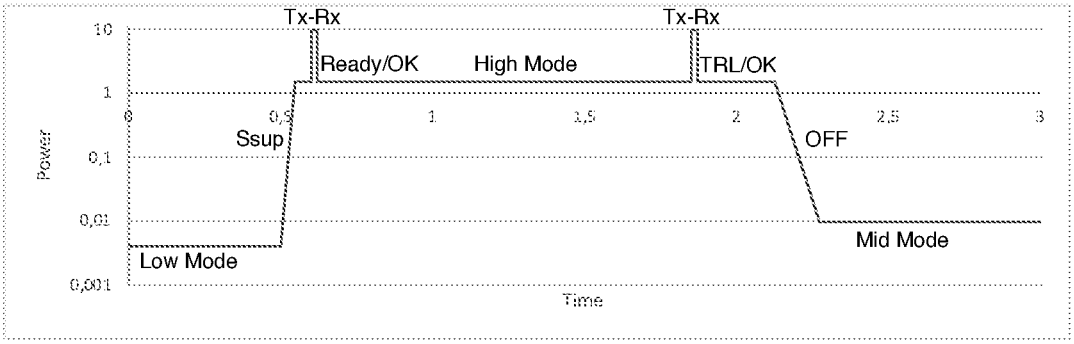

With reference to the accompanying drawings and particularly to FIG. 6, the energy consumption according to the proposed patent is shown, in particular related to a situation of activation of the die after a prolonged rest, to perform a roll and start using the device within a game (which, presumably, will require repeated rolls). This situation involves the transition from a Low Mode minimum power consumption state, said consumption being significantly lower than that of the commercial electronic dice, to an active state and transmission of the result (once a stable position has been reached), and then to a Mid Mode reduced consumption mode, said consumption being considered almost equivalent to that of the commercial dice, for the sole purpose of ensuring the necessary speed and sensitivity of response, during the subsequent game steps.

In particular, said FIG. 6 shows the sequence in which the die (100), being in Low Mode minimum consumption mode, is externally and vigorously stressed by the player (with a stress of high intensity and duration, both surpassing the threshold parameters Dm.L and Tm.L), in order to use it during the game, with a remote terminal (200) or mediator (300) connected and ready to receive the result of the roll. Said graph comprising the steps of:

- initial state in Low Mode minimum consumption mode;
- transition to TX-RX mode due to a significant external stress detected by the accelerometer and intensity above a predetermined upper activation threshold Ssup;
- verifying the presence of remote game terminals (200), or mediators (300), by means of a handshake mechanism (READY/OK—sending the READY message, receiving affirmative confirmation from the remote device) with said devices;
- transition in High Mode;
- acquisition of the stable roll result;
- automatic transition in TX-RX mode;
- broadcasting of the roll result after verification of the affirmative reception of the TRL/OK transmission attempt;
- switching off the Radio (106) and CPU (105) components and transitioning to Mid Mode reduced consumption mode;

It should be further noted that the development and time duration of the steps shown in FIG. 6 is not fixed but, thanks to the aforementioned READY/OK and TRL/OK handshake mechanisms, the system, while employing the most energy-consuming transmission resources (106) twice, does so only for minimal, strictly necessary times, immediately stopping the broadcasting of the READY activation state and the transmission of the result TRL, as soon as the external device sends reception confirmation, without the need to repeat the transmission for a number N of repetitions and/or for a predetermined time, as instead occurs in the traditional type of dice. It should also be noted that the use of a two-way communication system allows to reduce the fixed and oversized times, typical of a traditional electronic die, conveniently allowing to switch to Mid Mode energy saving mode as soon as the sequence is complete and the result obtained has been successfully transmitted. Finally, it should be noted that in addition to saving energy, the early return to Mid Mode also allows the die to be prepared earlier for any subsequent rolls.

Figure 7:
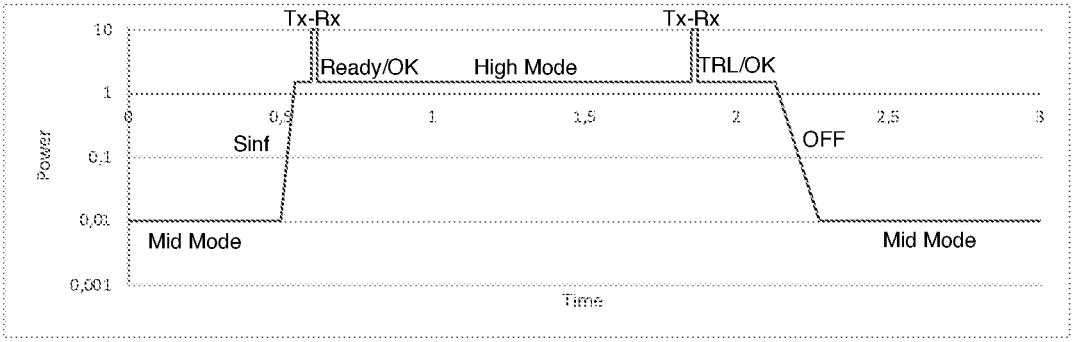

With reference to the accompanying drawings and particularly to FIG. 7, the energy consumption according to the proposed patent is shown during a series of two successive rolls, said sequence being obviously reproducible by series of multiple rolls. In this case, the system starts from a Mid Mode reduced consumption state and, once the result is acquired and transmitted, returns to the same initial Mid Mode reduced consumption state, thus preparing for any subsequent rolls.

In particular, the aforementioned FIG. 7 shows the sequence in which the die (100), initially in Mid Mode reduced consumption mode, is normally used by the player during the game by picking up and moving it to roll it (thus generating a stress of reduced intensity and duration, but still higher than the threshold parameters Dm.M and Tm.M), with a remote terminal (200) or mediator (300) connected and ready to receive the roll result.

Said graph comprising the steps of:

initial state in Mid Mode reduced consumption mode;

transition to TX-RX transmission mode due to external stress detected by an accelerometer of intensity greater than a predetermined lower activation threshold Sinf;

verification of the presence of remote game terminals (200), or mediators (300), by means of a handshake mechanism with a positive READY/OK result of the transmission with said devices;

transition in High Mode;

acquisition of the stable roll result;

automatic transition in TX-RX transmission mode;

broadcasting of the roll result and verification of the successful receipt of the TRL/OK transmission attempt;

switching off the Radio (106) and CPU (105) components and transitioning to Mid Mode reduced consumption mode;

Also in this context, the development and time duration of the steps shown in FIG. 6 is not fixed but, thanks to the READY/OK and TRL/OK handshake mechanisms, the system, while employing the most energy-consuming transmission resources (106) twice, does so only for minimal, strictly necessary times, immediately stopping the broadcasting of the READY activation state and the transmission of the result TRL, as soon as the external device sends reception confirmation, without the need to repeat the transmission for a number N of repetitions and/or for a predetermined time, as occurs in the traditional type of dice. This allows to reduce the fixed and oversized times typical of a traditional electronic die, conveniently allowing to return, upon transmission of the roll result, to the Mid Mode reduced consumption mode, preparing immediately for any subsequent rolls.

Figure 8:
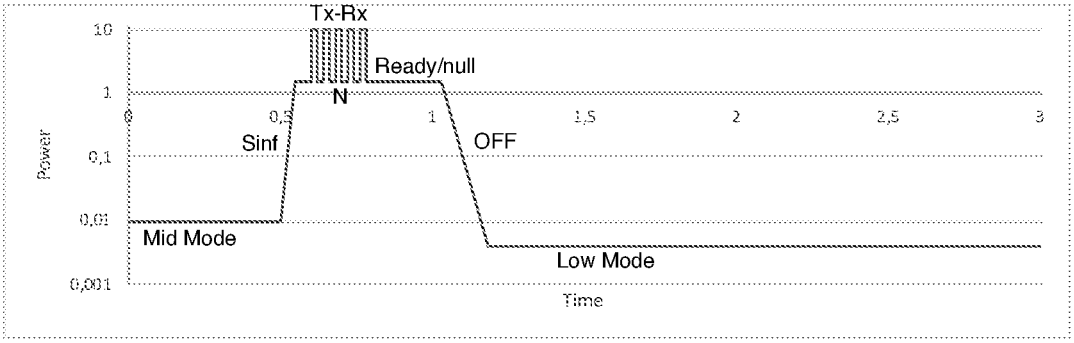

With reference to the accompanying drawings and particularly to FIG. 8, the energy consumption according to the proposed patent is shown in the case of superfluous use of the die (100), i.e., in the case where said die is arranged for use, being in Mid Mode reduced consumption mode, but it is not really necessary to use it since the receiving apparatus (remote device or mediator) is not active or adequately arranged. This can occur, for example, due to unexpected stresses on the accelerometer attributable for example to environmental problems such as vibrations, accidental displacement of the dice or simple mistakes of the player or alternatively, due to problems related to the connection with the game terminals (200, 300) if, for example, said terminals (200, 300) are not connected for various reasons (early termination of the game, suspension, deactivation, interruption of the connection with the connected game terminals, etc.).

In this context, the system, starting from a Mid Mode reduced consumption state and being randomly activated or voluntarily activated, but without the remote terminal (200) or mediator (300) being in conditions to receive the roll result, does not waste energy to enter the active state and determine the roll result, but also switches to Low Mode minimum energy consumption mode, waiting for any voluntary interaction that will return it to a state of predisposition to the game.

Said graph of FIG. 8 comprising the steps of:

initial state in Mid Mode reduced consumption mode;

transition to the TX-RX state due to an external stress detected by the accelerometer of intensity greater than a predetermined lower activation threshold (Sinf);

verification, with negative results, of the presence of remote game terminals (200), or mediators (300), by means of a READY/Null handshake mechanism with said devices and any redundancy mechanism (N transmission attempts);

switching off the Radio (106) and CPU (105) components and transitioning to Low Mode consumption mode;

Thanks to this sequence, the die (100), in case of unwanted stresses or in case of desired stresses but with the receiving devices not ready, reasonably arranges for maximum energy savings, that is, enters the Low Mode minimum consumption mode, having received no response to the READY signal thereof.

Figure 9:
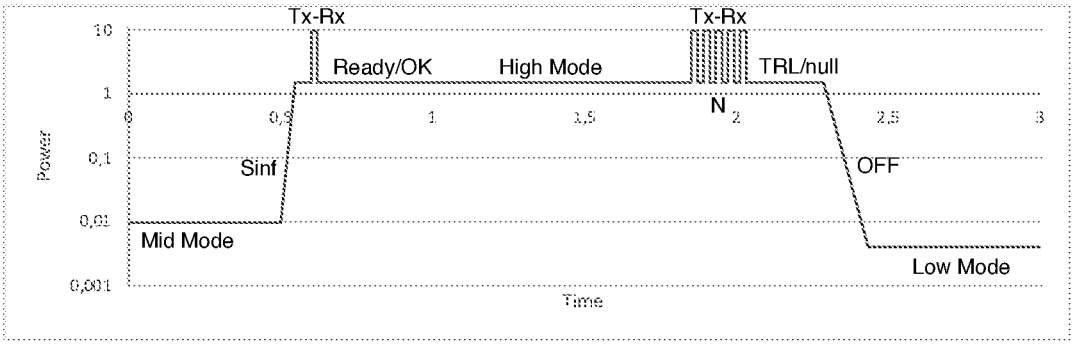

With reference to the accompanying drawings and particularly to FIG. 9, the energy consumption according to the proposed patent is shown in a limit case in which the game is interrupted or the receiving station is missing during a roll. In this case, the system starts from a Mid Mode reduced consumption state and, once the result is acquired, tries to transmit it, but without receiving a response; in this situation, therefore, the die automatically goes into the Low Mode minimum consumption state, allowing energy absorption to be reduced.

In particular, the aforementioned FIG. 9 shows the sequence in which the die (100), being in Mid Mode reduced consumption mode, is normally used by the player during the game by picking up and moving it to roll it (thus generating a stress of reduced intensity and duration, but still surpassing the threshold parameters Dm.M and Tm.M), with a remote terminal (200) or mediator (300) temporarily connected and ready to receive the result of the roll; said remote terminal (200) or mediator (300), after having given confirmation of availability in the Ready/OK handshake step, is switched off or disconnected due to a fault or the end of the game time, no longer being available to receive the result, once the die has reached a stable position.

Said graph comprising the steps of:

initial state in Mid Mode minimum consumption mode;

transition to the TX-RX state due to external stress detected by an accelerometer of intensity greater than a predetermined lower activation threshold Sinf;

verification of the presence of remote game terminals (200) by means of the READY/OK handshake mechanism with said devices;

transition in High Mode;

acquisition of the stable roll result;

automatic transition in TX-RX transmission mode;

broadcasting with negative outcome of the roll result with TRL/Null handshake verification of the reception after each transmission attempt and redundancy mechanism with N transmission attempts;

switching off the Radio (106) and CPU (105) components and transitioning to Low Mode consumption mode;

With this sequence, the highly unlikely possibility is also supported that the receiving apparatus will interrupt the operation thereof during a roll and, conveniently, the die will attempt to transmit the roll result for N number of attempts (to ensure the effectiveness of the transmission even in case of any interference or disturbance situations or errors), after which, not receiving confirmation, instead of returning to reduced consumption mode (Mid Mode) it will automatically put itself into minimum consumption mode, reducing energy expenditure and limiting (thanks to the adoption of the upper activation threshold) the possibilities of involuntary or accidental activation, contributing to further limit consumption.

Figure 10:
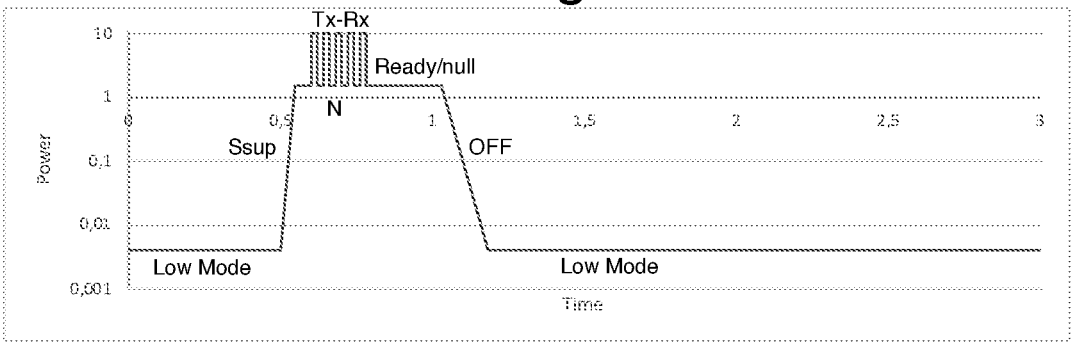

With reference to the accompanying drawings and particularly to FIG. 10, the energy consumption according to the proposed patent is shown with the superfluous use of the die (100), i.e., if said die is in Low Mode minimum consumption mode and is accidentally activated, faced with prolonged and high stress, but it is not really necessary to use it, since no game session is in progress and the receiving apparatus or mediator is not predisposed. This can occur due to unexpected stresses on the accelerometer due, for example, to environmental problems, such as high intensity vibrations, accidental and prolonged shaking of the dice, or simple player errors. In this context, the system, starting from a Low Mode minimum consumption state, requires high stresses for a prolonged time to be activated, which makes inadvertent accidental activation highly unlikely; should this eventuality occur, since no receiving device is present, the die does not waste energy to enter the active state and determine the roll result, but also returns to Low Mode minimum consumption mode, waiting for a new voluntary interaction to return it to a state of predisposition to play.

Said graph of FIG. 10 comprising the steps of:

initial state in Low Mode minimum consumption mode;

transition to the TX-RX state due to an external stress detected by the accelerometer of intensity greater than a predetermined upper activation threshold Ssup;

verification, with negative results, of the presence of remote game terminals (200), by means of a READY/Null handshake mechanism with said devices and any redundancy mechanism with N transmission attempts;

switching off the Radio (106) and CPU (105) components and transitioning to Low Mode consumption mode;

Thanks to this sequence, the die (100), in the event of unwanted stresses or accidental activation, automatically returns to the condition of maximum energy saving, having not received a response to its READY signal.

With reference to the accompanying drawings, and particularly to FIG. 11, the typical structure of a table (600) related to the parameters preloaded in the memory (107) of the microcontroller (104) is shown in detail; said table can be used to dynamically define the settings useful for the general operation of the control board (102) and particularly of the accelerometer (103), to define appropriate settings and tolerances of the processes for acquiring the result of the die (100).

The energy saving performance of the die (100), according to the proposed patent, strongly depends on the ability of the electronic board to discern stimuli not connected to the actual game, in order to exploit the energy components only if necessary and only for the time strictly useful for the correct acquisition and transmission of the result of a roll. It follows that the adequacy of the transition thresholds between states and the correct identification of the stable result in an adequate and minimum time are crucial to achieve significant energy saving. Unfortunately, these performances can be affected (in terms of saving or even worse in terms of reliability) depending on adverse environmental conditions (irregularities of the game plane, environments subject to vibrations such as trains, ships, planes, etc.). These stimuli and external elements cannot be managed dynamically and in real time, unless they are accompanied by devices of absolutely unrealistic complexity, size and cost.

To this end, the patent further involves loading in the memory (107) a look-up table (600) which provides the parameters for setting the control board (102) with the varying of Z possible environmental situations selectable by the player, allowing the apparatus to always operate in an optimal or almost optimal condition.

Said parameters include those related to the accelerometer (103), i.e., three sampling intervals [Dt.L, Dt.M, Dt.H] and the parameters defining the upper Ssup [Dm.L, Tm.L] and lower Sinf [Dm.M, Tm.M] activation thresholds, which may be suitably modified to ensure the effectiveness of the consumption reduction mechanism under different conditions of use. Consider, for example, the use of the die during a trip in a vehicle or in the presence of environmental vibrations produced by machinery or other factors. In this situation the standard threshold Sinf may not be adequate because, in the presence of overly low thresholds, vibrations could result in frequent accidental activations of the apparatus, resulting in increased consumption; the setting of different thresholds (higher than normal) allows to effectively filter environmental disturbances, to the detriment of a minimum reduction in the reactivity of the apparatus.

Similarly, in anticipation of a long transport of the equipment with vehicles strongly subject to vibration, it may be desirable to modify the values of the upper threshold Ssup, to avoid even accidental activations, ensuring a lower consumption of the batteries.

Further parameter variations could be defined, for example, to "customize" the responsiveness of the dice during the game, based on how each player usually picks up and shakes the dice, before a roll, etc.

Said table (600) further includes two parameters dm.x and DV.x which, with the varying of Z possible environmental situations, allow respectively to fix tolerances on the detection of the gravity vector and on the achievement of a stable position of the die.

In detail, the parameter dm.x, which can be set a priori, is a parameter to compensate for geometric irregularities which, with the varying of Z scopes of use, can affect the correct acquisition of the gravity vector of the accelerometer (103) at the end of a roll. In particular, the parameter dm.x of spatial stability of the die (100) is used to interpret and possibly compensate for small inconsistencies between the gravity vector Vg(x,y,z) measured by the accelerometer (103) at the end of the rolls of the die (100) with respect to the theoretical values expected for the recognition of the roll result. Such inconsistencies may be attributable, for example, to irregularities in the game plane on which the dice are rolled or to the inclination of the medium on which the die is located or of the game board. To this end, it will thus be necessary to discern, during the rolls, whether the deviation between the actual gravity vector measured by the accelerometer (103) during the roll and the theoretical value of the expected gravity vector is tolerable or not. This is to discern if there are small deviations attributable to surface defects or actual interferences from the game environment, or if an unreliable or invalid roll has actually occurred (die incorrectly positioned, for example on an edge, or inclined due to the presence of obstructions and interfering objects, etc.).

The parameter dm.x will therefore allow to set the limit within which said deviations of the gravity vector are acceptable by the microcontroller (104) of the die (100), allowing the optimization of the detection process of the roll result with the varying of Z environmental situations preloaded in the memory (107) and predefined a priori, particularly depending on the different features such as the type or regularity of the rolling surface and further according to the shape and number of faces of the die (100) used, which reasonably influence the stability tolerance of the gravity vector from the geometric point of view.

Similarly, the parameter DV.x defines, when the varying of Z environmental situations, the tolerance margins on the achievement of asymptotic stability of the die, once rolled. Therefore, the parameter DV.x establishes the minimum acceptable stress intensity so that the die can be considered reliably "stopped" and therefore, the process of analysing the orientation of the gravity vector aimed at determining the outcome of the roll can be started. In fact, in some game situations the support surface may not be completely stationary but, on the contrary, it may be constantly subject to vibrations generated by external factors, such as the aforementioned vibrations of the vehicle in which the game is in progress or caused by the presence of machinery or other devices in the vicinity; the parameter DV.x will therefore allow to define the tolerance level of the die stability verification procedure, conveniently allowing to provide correct results even in conditions of precarious stability or presence of external disturbance factors and above all, reducing, in these particular conditions, the detection times of the stable position, allowing the transmission of the result to begin more quickly and, consequently, the activation of the energy saving mode.

According to a further and possible implementation, the parameters of said table (600) may, if necessary, be modified by remote configuration by the connected game device (200) or the mediator (300), for example to update its values or to create presets useful for customizing the user experience and making it more suitable for different games or different types of users. In addition, learning and data mining procedures may be provided to dynamically optimize these parameters based on previous use.

Figure 12:
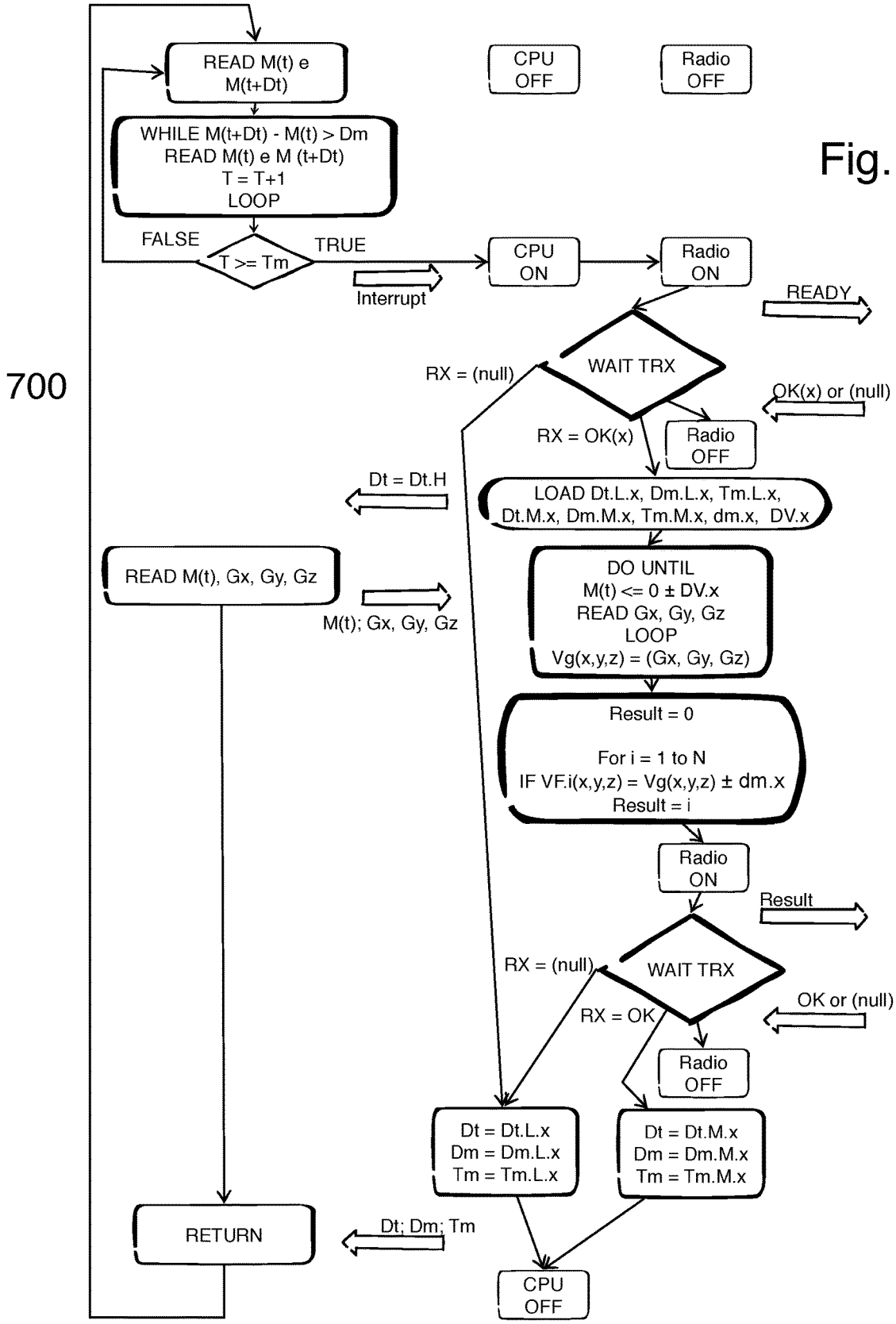
FIG. 12 shows the algorithm related to the energy consumption management method and, in particular, of passage between the various operating modes, with detail of the activation of the different energy components of the electronic board of an electronic RF die.

With reference to the accompanying drawings and particularly to FIG. 12, the algorithm (700) is shown which defines the transitions between the various operating and energy consumption modes with the varying of the data measured by the accelerometer (103) and the settings illustrated in FIG. 3 and FIG. 11 and are suitably preloaded into the memory (107) of the microcontroller (102).

In particular, the algorithm (700) provides the following variables/parameters:

- M(t), [Gx, Gy, Gz]: Instantaneous value of the magnitude of movement (stress) and instantaneous value of the gravity vector, measured by the accelerometer (103);
- M(t+Dt): Instantaneous value of the amount of movement (stress) measured by the accelerometer (103) and detected at a later time (t+Dt), variable depending on the sampling period Dt set, depending on the activation state of the device.
- [Dt, Dm, Tm]: sampling interval, minimum movement intensity threshold considered, minimum duration of stimuli surpassing said minimum intensity threshold, related to the accelerometer (103); said parameters are set dynamically on the accelerometer (103) depending on the activation state and, in particular, with respect to the Low Mode minimum energy consumption and Mid Mode reduced energy consumption states. For the sake of completeness, it should be recalled that in High Mode a high sampling frequency is used for the accelerometer, while in TX-RX transmission/communication mode the accelerometer is not used.
- [Dt.L.x, Dm.L.x, Tm.L.x], [Dt.M.x, Dm.M.x, Tm.M.x] with 1<x<Z: presets related to Z possible situations of use and/or functional configuration of the system (customizations) and concerning respectively the sampling interval (hence the sampling frequency), the minimum intensity and the minimum duration of the stimulus M(t) said parameters to be used to define the detection thresholds of the accelerometer (103); said preset values preloaded in the memory (107) of the microcontroller (104) in the form of a look-up table (600) and possibly modifiable or updatable through an external system connected with the die.
- dm.x with 1<x<Z: presets related to Z possible situations of use and inherent to the limit within which any deviations of the gravity vector detected with respect to the perfect orthogonality with the support face, are acceptable in terms of precision in determining the roll result of the die (100).
- DV.x with 1<x<Z: presets related to Z possible situations of use and inherent tolerance margins in terms of instantaneous variation of stress between two successive moments, to define the achievement of asymptotic stability of the die, once rolled.
- Vg(x,y,z): orientation of the gravity vector, calculated based on the components [Gx, Gy, Gz], provided by the accelerometer (103) at the end of the roll or asymptotically stable.
- VF.i(x,y,z) with 1<i<N where N is the number of faces of the die: vector which identifies the orientation which the gravity vector must assume when the die is in stable equilibrium and shows, on the exposed upper face(s), the roll result. In fact, the vector VF.i corresponds to the vector orthogonal to the face opposite the face i.

Also with reference to the same FIG. 12, the following commands and checks are identified:

- [CPU OFF, CPU ON], [RADIO OFF, RADIO ON]: related to the implementation of the energy-consuming components of the CPU (105) and communication/radio system (106) of the die (100);
- WAIT TRX: Handshake step of waiting for response to the transmission made (READY or roll result) for the purpose of checking for the presence of game terminals (200) or mediators (300) connected [READY/OK] or for the verification of correct transmission of the roll result of the die (100) [TRL/OK]

Algorithm 700 of FIG. 12, in particular, comprises the following steps:

The die (100) is in an energy-saving condition (alternatively Low Mode or Mid Mode, depending on what occurred previously), with CPU (105) and the radio component (106) of the microcontroller (104) off and accelerometer (103) active with sampling interval Dt and detection threshold with intensity Dm and time threshold Tm (these parameters will correspond to the values of the variables set at the end of the previous period of use).

The accelerometer (103) samples, with scanning interval Dt, the stresses undergone by the die (100); when these surpass the intensity threshold Dm, the accelerometer (103) verifies if the time for which said stress remains above the threshold Dm is greater than Tm; if both conditions are verified, the accelerometer (103) sends an interrupt signal to the microcontroller, activating it.

The microcontroller (104) is activated and the system switches to TX-RX transmission mode, interrupting the detection of the accelerometer (103) and sending the "Ready" signal in broadcasting, to check for the possible presence of available game devices (200) or mediators (300). At the end of each of the N transmission pulses (where N is a prefixed integer value which defines the number of attempts to be made before deciding that no one is listening), the system remains in receive mode to check for any responses.

If no game device (200) or mediator (300) responds within the set number of attempts, the system interprets the response as null and automatically switches off the radio part (106), sets the parameters Dt, Dm and Tm of the accelerometer (103) as per the threshold Ssup envisaged for the Low Mode [Dt.L.x, Dm.L.x and Tm.L.x] of the last setting (x) previously used, and also switches off the CPU component (105), returning to the initial situation, i.e., accelerometer (103) listening, microcontroller (104) deactivated, waiting for signal from the accelerometer (103).

If a third system is also available, the handshaking "READY" communication by the die (100) receives an OK(x) response, where "x" is an integer value between 1 and Z indicating which of the presets to use. Based on the value of x, therefore, the CPU (105) switches off the radio (106), loads the set of corresponding parameters from the look-up table inside the memory (107) and at the same time communicates to the accelerometer (103) to activate with minimum sampling interval Dt.H (which determines a high sampling frequency) and goes into High Mode.

The accelerometer (103) constantly detects and communicates the values of the total stress detected (M(t)) and the filtered values of the gravity vector, on the three axes [Gx, Gy, Gz]. The CPU (105) receives such data and compares the total stress value (M(t)) with the value "0+−DV.x", thereby detecting when the die has reached an "asymptotically stable" position. It should be noted that, as conditions vary, the parameter DV.x may be more or less large, thus defining a more or less forced stability level, in order to identify the achievement of a stability situation even in the presence, for example, of vibrations or external disturbance factors.

When the stability of the die (M(t)<=0+−DV) is reached, the values of the gravity vector Vg (x,y,z) are compared with the possible permissible values VF.i, corresponding to the orientation envisaged for the gravity vector, depending on the value of the exposed face (i); in order to allow both a certain tolerance in the accuracy of the detection of the gravity vector, and the use on irregular surfaces, a variability +−dm.x is allowed for the components of the gravity vector, with respect to the predetermined values for the faces of the die (100), depending on the preset (x) used.

If at least one of the expected values VF.i corresponds, less the tolerance +−dm.x, to the gravity vector Vg(x, y,z) detected, the CPU (104) sets the result as equal to "i"; if, on the contrary, the orientation assumed by the die does not correspond to any of the acceptable results, the result is set to 0 (corresponding to an invalid roll result).

The system switches to transmission mode, switches off the accelerometer (103), activates the radio (106) and transmits the result value, waiting for a response from the TRL/OK receiving third systems.

If no third system responds within the prefixed number of attempts, the system interprets the response as null and automatically turns off the radio part (106), sets the parameters Dt, Dm and Tm of the accelerometer (103) as per the thresholds provided for the Low Mode [Dt.L.x, Dm.L.x and Tm.L.x] of the setting (x) used, and also turns off the CPU component (105), returning to the initial situation, i.e., accelerometer (103) listening, microcontroller (104) off, waiting for a signal from the accelerometer (103).

If a third system is available and active, after the communication of the result the die will receive the response "OK"; thus the microcontroller turns off the radio part (106), sets the parameters Dt, Dm and Tm of the accelerometer as per the thresholds envisaged for Mid Mode [Dt.M.x, Dm.M.x and Tm.M.x] of the setting (x) used, and finally turns off the CPU component (105), returning to the initial situation, i.e., accelerometer (103) listening, microcontroller (104) deactivated, waiting for a signal from the accelerometer (103).

INDUSTRIAL APPLICABILITY

The proposed system can conveniently be used to significantly reduce the power consumption of said electronic RF dice and increase the operating autonomy thereof. In addition, the proposed system can allow, with the same operating duration required, the use of lower-capacity batteries which notoriously lead to smaller dimensions and an effective miniaturization of the devices. Finally, the system obtained allows to reduce the power consumption of various types of dice regardless of the type, shape, results and functions thereof.

The invention can be obtained with technical equivalents, with supplementary materials or solutions suitable for the purpose and the application scope. Conformation and dimensions of the constituent parts may vary in a suitable, but consistent way with the proposed solution. By way of example and not of limitation, it is noted that the geometric shapes of the involved parts may be varied while maintaining the above-mentioned functionalities. In addition, the technology implemented for the wireless transmission between the die and the receiving electronic device and especially the type of protocol used may be changed, without however leaving the scope of the peculiar features and functions of the system proposed and claimed below, as may be used for the detection of stresses and movements of the die, device and components alternative or complementary to the accelerometer, such as gyroscope or other types of sensors in degrees of detection of displacements, angular vibrations, movements or mechanical stresses. By varying these implementations, it will be necessary to change the conditioning, acquisition and communication circuits between elements, without, however, departing from the purpose and scope of application of the proposed solution.

The invention claimed is:

1. A system for reducing consumption of an electronic die, comprising:

an electronic board configured to transmit a roll result to a remote terminal, wherein the electronic board comprises an accelerometer and a microcontroller, and wherein the microcontroller comprising a central processing unit (CPU), a radio communication device, and a memory; and the electronic die with a number of faces, wherein the system is configured to transition between four operating modes for controlling the accelerometer and the microcontroller, the operating modes being used to control the CPU and the radio communication device and to set a sampling interval of the accelerometer, the operating modes comprising:

a first consumption mode in which the CPU is deactivated, the radio communication device is deactivated, and the sampling interval is set to a first value, a second consumption mode in which the CPU is deactivated, the radio communication device is deactivated, and the sampling interval is set to an second value, a third consumption mode used to determine the roll result of the electronic die, in which the CPU is activated, the radio communication device is deactivated, and the sampling interval is set to a third value, and a fourth consumption mode used for communicating, to the remote terminal, the roll result of the electronic die, in which the CPU is activated, the radio communication device is activated, and the accelerometer is switched off, wherein a transition between the four operating modes is adjusted depending on a stimulus applied to the electronic die, and based on detection of surpassing of thresholds of minimum intensity and minimum duration of the stimulus measured by the accelerometer, the means-adjustment comprising:

an upper threshold, characterized by upper intensity and upper duration, the upper threshold being used to determine the transition from the first consumption mode to the fourth consumption mode, and a lower threshold characterized by lower intensity and lower duration, the lower threshold being used to determine the transition from the second consumption mode to the fourth consumption mode wherein the transition between the four operating modes is adjusted_depending on an availability of the remote terminal to communicate with the electronic die, the adjustment comprising:

a first handshake to confirm the availability of the remote terminal, the first handshake being used to determine the transition from the fourth consumption mode to the third consumption mode, a second handshake to confirm an unavailability of the remote terminal, the second handshake being used to determine the transition from the fourth consumption mode to the first consumption mode, a third handshake to check the availability of the remote terminal following a transmission of the roll result of the electronic die, the third handshake being used to determine the transition from the fourth consumption mode to the second consumption mode, and a fourth handshake for confirming the unavailability of the remote terminal following the transmission of the roll result of the electronic die, the fourth handshake being used to determine the transition from the fourth consumption mode to the first consumption mode and wherein the first value, the second value, the third value, the upper threshold, and the lower threshold are adapted to different environmental situations in which the electronic die is used to select a set of values based on a look-up table preloaded in the memory of the microcontroller.

2. The system for reducing the consumption of the electronic die according to claim 1, wherein the upper intensity of the upper threshold is greater than the lower intensity of the lower threshold, and wherein the upper duration of the upper threshold is greater than the lower duration of the lower threshold.

3. The system for reducing the consumption of the electronic die according to claim 1, wherein the first value of the sampling interval is greater than the second value of the sampling interval, and wherein the second value of the sampling interval is greater than the third value of the sampling interval.

4. The system for reducing the consumption of the electronic die according to claim 1, wherein the look-up table comprises a total number of rows, wherein the total number of rows corresponds to a number of the environmental situations in which the electronic die is, and wherein the rows comprises data of presets of the first value, the second value, and the third value of the sampling interval of the accelerometer and the rows further comprising data of presets for the upper intensity and the upper duration of the upper threshold, and the lower intensity and the lower duration of the lower threshold.

5. The system for reducing the consumption of the electronic die according to claim 4, wherein the look-up table further comprises an asymptotic stability parameter for determining an end of a roll of the electronic die, the asymptotic stability parameter defining, based on the environmental situations in which the electronic die is used, a maximum permissible threshold for a signal strength measured by the accelerometer, wherein the signal strength is less than or equal to the asymptotic stability parameter.

6. The system for reducing the consumption of the electronic die according to claim 1, wherein the look-up table further comprises a compensation parameter for geometric irregularities, the compensation parameter being used during the determination of the roll result of the electronic die to define a permissible deviation between a gravity vector detected by the accelerometer at an end of a roll and expected values of the gravity vector for possible roll results of the electronic die.

7. The system for reducing the consumption of the electronic die according to claim 4, wherein the look-up table further comprises a compensation parameter for geometric irregularities, the compensation parameter being used during the determination of the roll result of the electronic die to define a permissible deviation between a gravity vector detected by the accelerometer at an end of a roll and expected values of the gravity vector for possible roll results of the electronic die.

8. The system for reducing the consumption of the electronic die according to claim 1, wherein the look-up table further comprises an asymptotic stability parameter for determining an end of a roll of the electronic die, the asymptotic stability parameter defining, based on the environmental situations in which the electronic die is used, a maximum permissible threshold for a signal strength measured by the accelerometer, wherein the signal strength is less than or equal to the asymptotic stability parameter.

9. The system for reducing the consumption of the electronic die according to claim 1, further comprising a mediator device connected wirelessly or wired with the remote terminal, the mediator device being used to acquire, store, and process the roll results of the electronic die.

10. The system for reducing the consumption of the electronic die according to claim 9, wherein the radio communication device is a first radio communication device, wherein the memory is a first memory, wherein the microcontroller is a first microcontroller, and wherein the mediator device comprises: a second radio communication device operably equivalent to the first radio communication device of the electronic board of the electronic die; a second memory; and a second microcontroller.

11. The system for reducing the consumption of the electronic die according to claim 9, wherein the look-up table comprises data configured to be used in remote modification by the remote terminal or by the mediator device.

12. The system for reducing the consumption of the electronic die according to claim 1, wherein the look-up table comprises data configured to be used in modification by data mining algorithms based on historical data series acquired by the accelerometer.

13. A method for identifying and transmitting a roll result, comprising:

providing an electronic board configured to transmit a roll result to a remote terminal, wherein the electronic board comprises an accelerometer and a microcontroller, and wherein the microcontroller comprising a central processing unit (CPU), a radio communication device, and a memory;

providing an electronic die with a number of faces, wherein the electronic die is configured to transition between four operating modes for controlling the accelerometer and the microcontroller, the operating modes being used to control the CPU and the radio communication device and to set a sampling interval of the accelerometer, the operating modes comprising:

a first consumption mode in which the CPU is deactivated, the radio communication device is deactivated, and the sampling interval is set to a first value, a second consumption mode in which the CPU is deactivated, the radio communication device is deactivated, and the sampling interval is set to an second value, a third consumption mode used to determine the roll result of the electronic die, in which the CPU is activated, the radio communication device is deactivated, and the sampling interval is set to a third value, and a fourth consumption mode used for communicating, to the remote terminal, the roll result of the electronic die, in which the CPU is activated, the radio communication device is activated, and the accelerometer is switched off, wherein a transition between the four operating modes is adjusted depending on a stimulus applied to the electronic die, and based on detection of surpassing of thresholds of minimum intensity and minimum duration of the stimulus measured by the accelerometer, the adjustment comprising:

an upper threshold, characterized by upper intensity and upper duration, the upper threshold being used to determine the transition from the first consumption mode to the fourth consumption mode, and a lower threshold characterized by lower intensity and lower duration, the lower threshold being used to determine the transition from the second consumption mode to the fourth consumption mode, wherein the transition between the four operating modes is adjusted depending on an availability of the remote terminal to communicate with the electronic die, the adjustment comprising:

a first handshake to confirm the availability of the remote terminal, the first handshake being used to determine the transition from the fourth consumption mode to the third consumption mode, a second handshake to confirm an unavailability of the remote terminal, the second handshake being used to determine the transition from the fourth consumption mode to the first consumption mode, a third handshake to check the availability of the remote terminal following a transmission of the roll result of the electronic die, the third handshake being used to determine the transition from the fourth consumption mode to the second consumption mode and a fourth handshake for confirming the unavailability of the remote terminal following the transmission of the roll result of the electronic die, the fourth handshake being used to determine the transition from the fourth consumption mode to the first consumption mode and wherein the first value, the second value, the third value, the upper threshold, and the lower threshold are adapted to different environmental situations in which the electronic die is used to select a set of values based on a look-up table preloaded in the memory of the microcontroller;

sampling and comparing the intensity of a signal measured by the accelerometer in a first instant and a second instant;

verifying, using the accelerometer, surpassing of the minimum intensity, wherein the difference between the second instant and the first instant is greater than the minimum intensity;

verifying, by the accelerometer, a potential persistence of the surpassing of the minimum intensity—for a time greater than the minimum duration;

in response to surpassing the minimum intensity and the minimum duration;

activating the CPU and a communication system of the microcontroller, and verifying a presence of the remote terminal or a mediator device, using at least one of the first handshake or the second handshake;

in response to satisfying the first handshake, acquiring a response parameter transmitted by the remote terminal or by the mediator;

selecting, in the look-up table, a set of parameters including the first value, the second value, the third value, the upper threshold, the lower threshold, geometric irregularities, and an asymptotic stability parameter corresponding to the environmental situation in which the electronic die is used;

setting the accelerometer and the microcontroller according to the selected set of parameters;

verifying a stable conclusion of a roll of the electronic die via the asymptotic stability parameter;

identifying the roll result of the electronic die based on a verification of deviations between a gravity vector detected by the accelerometer at an end of the roll and expected values of the gravity vector for possible roll results via a compensation parameter for the geometric irregularities;

sending the roll result and verifying the presence of the remote terminal or the mediator device using the third handshake or the fourth handshake;

setting the accelerometer based on a positive outcome of the third handshake or a negative outcome of the fourth handshake of a communication of the roll result;

setting current parameters according to the lower threshold in response to a positive outcome of the communication and setting the current parameters according to the upper threshold in response to a negative outcome of the communication; and switching off the microcontroller and returning to predefined initial conditions.

* * * * *